US008793820B2

(12) United States Patent
Hodak

(10) Patent No.: US 8,793,820 B2
(45) Date of Patent: Aug. 5, 2014

(54) SWIMMING POOL SKIMMER PLUG AND WINTERIZATION SYSTEM

(76) Inventor: Jerry Hodak, Zelienople, PA (US)

( * ) Notice: Subject to any disclaimer, the term of this patent is extended or adjusted under 35 U.S.C. 154(b) by 503 days.

(21) Appl. No.: 13/152,407

(22) Filed: Jun. 3, 2011

(65) Prior Publication Data

US 2011/0296601 A1 Dec. 8, 2011

Related U.S. Application Data

(60) Provisional application No. 61/352,425, filed on Jun. 8, 2010.

(51) Int. Cl.

| | |
|---|---|
| ***E04H 4/00*** | (2006.01) |
| ***E04H 4/12*** | (2006.01) |
| ***E04H 4/14*** | (2006.01) |

(52) U.S. Cl.

CPC ..... *E04H 4/14* (2013.01); *E04H 4/1272* (2013.01)

USPC ..... 4/508

(58) Field of Classification Search

CPC ..... E04H 4/12

USPC ..... 4/488–513

See application file for complete search history.

(56) References Cited

U.S. PATENT DOCUMENTS

| | | | | |
|---|---|---|---|---|
| 3,900,130 | A * | 8/1975 | Andrews | 220/378 |
| 4,126,925 | A * | 11/1978 | Jacuzzi | 29/428 |
| 4,657,673 | A * | 4/1987 | Kessler | 210/108 |
| 4,735,714 | A * | 4/1988 | Schall | 210/167.1 |
| 4,913,810 | A * | 4/1990 | Hodak | 210/167.12 |
| 5,040,250 | A * | 8/1991 | Barnes et al. | 4/494 |
| 5,604,939 | A * | 2/1997 | Widener | 4/507 |
| 5,937,453 | A * | 8/1999 | Hodak et al. | 4/508 |
| 5,948,245 | A * | 9/1999 | Hodak | 210/167.18 |
| 6,214,217 | B1 | 4/2001 | Sliger, Jr. | |
| 6,578,208 | B1 * | 6/2003 | Lytle | 4/507 |
| 6,701,542 | B2 * | 3/2004 | Marbach | 4/507 |
| 6,817,041 | B1 | 11/2004 | Evans et al. | |
| 7,052,602 | B2 * | 5/2006 | Boggs et al. | 210/167.1 |
| 7,195,708 | B2 | 3/2007 | Mullner, Jr. | |
| 7,291,260 | B2 | 11/2007 | Mullner, Jr. | |
| 7,413,651 | B2 | 8/2008 | Hodak | |
| 2008/0216877 | A1 * | 9/2008 | Lawson | 134/111 |

* cited by examiner

*Primary Examiner* — Lori Baker

(74) *Attorney, Agent, or Firm* — James Ray & Assoc.

(57) ABSTRACT

The present invention is skimmer plug for winterizing a pool. The skimmer plug inserts and grips into the fluid opening, where there is fluid passage from the pool to the skimmer housing and filter assembly. In this manner, the surface of the skimmer plug when installed is slightly raised from the factory skimmer faceplate or skimmer opening by only the thickness of the skimmer plug's outer plate. The fasteners which secure the factory skimmer faceplate and the skimmer housing to the pool sidewall still remain accessible for adjustment by the pool owner or pool service personnel while the skimmer plug is securely in place.

19 Claims, 8 Drawing Sheets

SWIMMING POOL SKIMMER PLUG AND WINTERIZATION SYSTEM

CROSS-REFERENCE TO RELATED APPLICATIONS

This application is related to and claims priority from U.S. Provisional Patent Application Ser. No. 61/352,425 filed on Jun. 8, 2010.

FIELD OF THE INVENTION

This invention generally pertains to swimming pools and swimming pool sanitation. More specifically, the present invention relates to a system for winterizing or servicing a swimming pool.

BACKGROUND OF THE INVENTION

The invention is particularly applicable to swimming pools and will be described with particular reference thereto. However, it will be appreciated by those skilled in the art that the invention has broader applications and may also be adapted for use in other water or fluid control applications.

Pools are traditionally drained below the opening of the skimmer intake in order to evacuate water from the skimmer housing and thus allowing for servicing or winterization of the pool. This procedure can waste thousands of gallons of water, as well as the related time in draining and refilling a large volume of water.

Currently to winterize and close off the opening of a pool skimmer, skimmer closing devices have been developed over the years to block water from entering the skimmer so that one could drain the water from the skimmer, rather than draining the pool below the skimmer opening, allowing the level of water in the pool to remain at normal operating levels. Many of these closing assemblies require the use of tools and the removal of the original factory skimmer faceplate and replacing it with a face plate to mate to a snap on cover that blocks the skimmer opening from water getting inside the skimmer.

Accordingly, it has been considered desirable to develop a new and improved system which would overcome the foregoing difficulties and others while providing better and more advantageous overall results

SUMMARY OF THE INVENTION

The present invention is skimmer plug for winterizing a pool. The skimmer plug inserts and grips into the fluid opening, where there is fluid passage from the pool to the skimmer housing and filter assembly. In this manner, the surface of the skimmer plug when installed is slightly raised from the factory skimmer faceplate or skimmer opening by only the thickness of the skimmer plug's outer plate. The fasteners which secure the factory skimmer faceplate and the skimmer housing to the pool sidewall still remain accessible for adjustment by the pool owner or pool service personnel while the skimmer plug is securely in place.

The skimmer plug is a ridged plastic plate made of HDPE, PVC, ABS or other similar type material that is rigid yet semi flexible and about ⅛ to ¼ inch in thickness or more, the plate generally measures slightly larger than that of the skimmer faceplate or skimmer opening so it does not push through and slip into the skimmer housing. The opposite side of this plate described above should be made from a cross linked (polyethylene) PE or neoprene rubber foam pad attached to the larger outer plate. Using a PSA (pressure sensitive adhesive) or waterproof glue, the foam pad will be bonded to the plate to make a single unit for use. This closed cell foam when inserted tightly into a skimmer opening has an unusual griping ability when wet. Once the foam makes it past the initial opening of the face plate or skimmer opening, it expands out over the inside edges with a popping noise and secures itself in place. This new design eliminates having to make a mating part for the lid to attach at substantially lower costs than other winter devices. After a few seasons of use, wore out foam pads could be sold separately as a replacement part for the skimmer plug saving the customer even more money.

The cross link PE or neoprene rubber foam pad is generally a closed cell material measuring an average of ½ inch in thickness or more, the closed cell material does not saturate with water after being submerged in the pool all winter long. The thickness of the foam pad will depend on the design of various pool skimmers sold.

The closed cell foam pad portion of the skimmer plug inserts snuggly into the opening of the skimmer face plate blocking out pool water from entering the skimmer during the winter months, or while servicing during the swim season. This new design allows the user to simply push and pop the plug into place without the use of any tools and would also be held in place by water pressure pushing against it. The new skimmer plug does not require a special mating faceplate to be used like other designs; the skimmer plug fits into any skimmer opening on the market today and works as a replacement lid for all of the other winterizing assemblies already in existence.

Another unique feature of the skimmer plug is the optional drain kit for certain model pools that need to maintain a proper water level during the winter months. This level is important since pool water will rise to a higher than normal level when the skimmer opening has been plugged, causing rain and snow to slowly build and overflow. In this situation, the water level has now risen to the top rails of the pool, and when the water freezes, it will expand and lift the top rails off the pool wall, causing damage to the structure not covered under warranty.

This optional hose kit is installed onto the skimmer plugs outer plate, using a thru wall fitting with a hose extending from it through the skimmers housing and out the bottom of the skimmer to day light, where the pool's pump and filter plumbing were removed for the winter. With the drain kit in place and water level rising, the water then leaks through the hose and out the bottom of the skimmer, creating a siphon. The water in the pool now maintains normal operating level all winter, ready for the summer.

Figure 1:
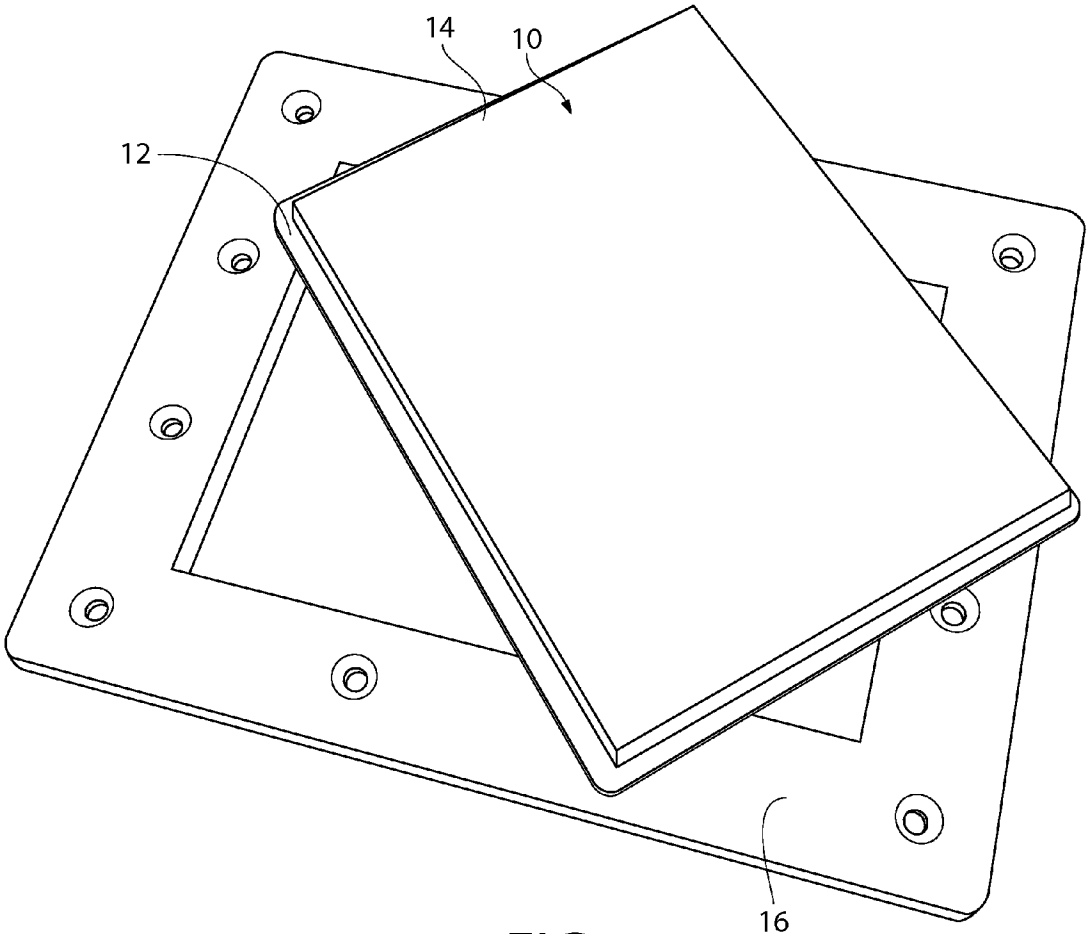
FIG. 1 is a general perspective view of one embodiment of the present invention with a standard skimmer faceplate.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 2:
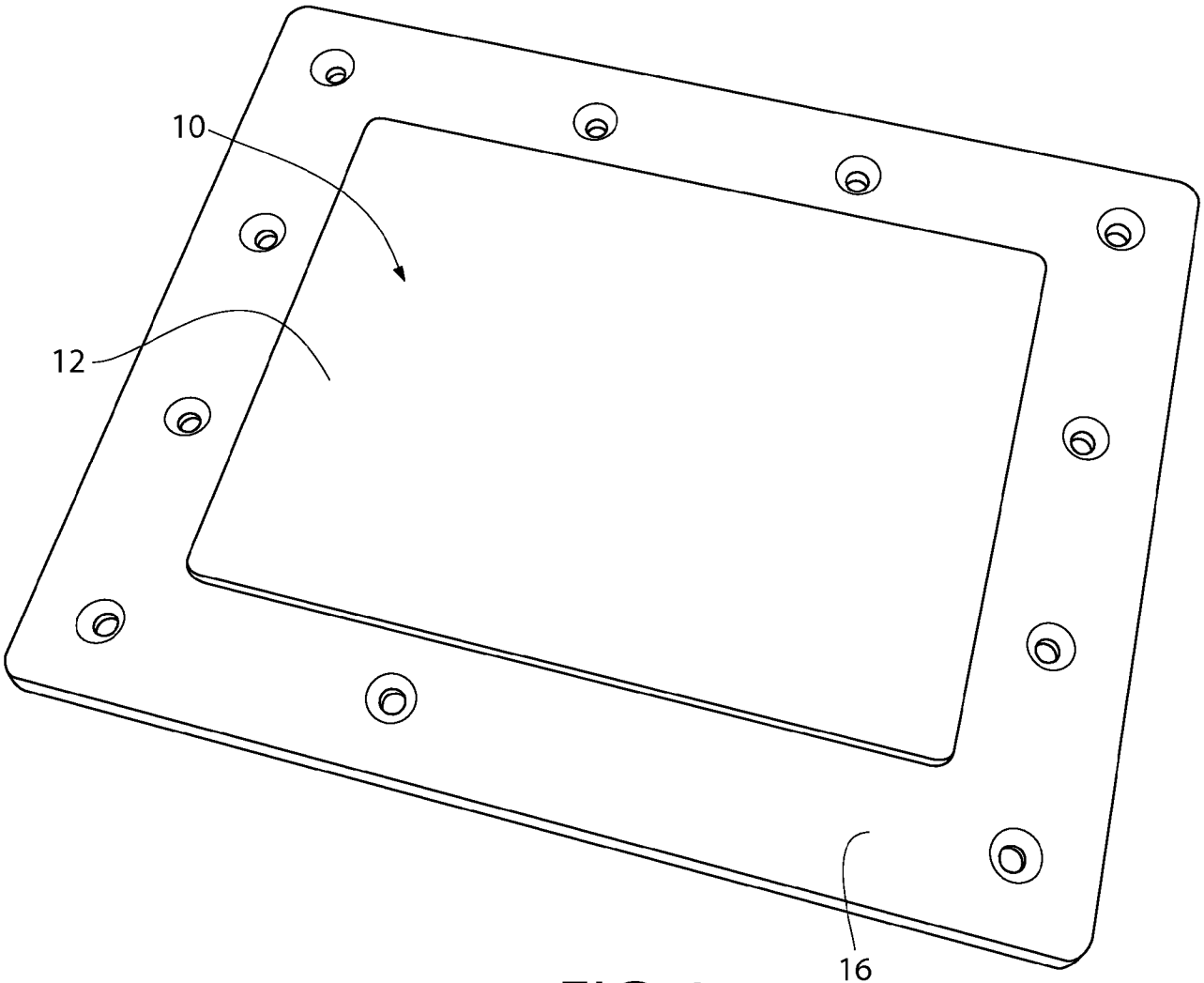
FIG. 2 is a general perspective view of another embodiment of the present invention inserted into a standard skimmer faceplate.
Figure 3:
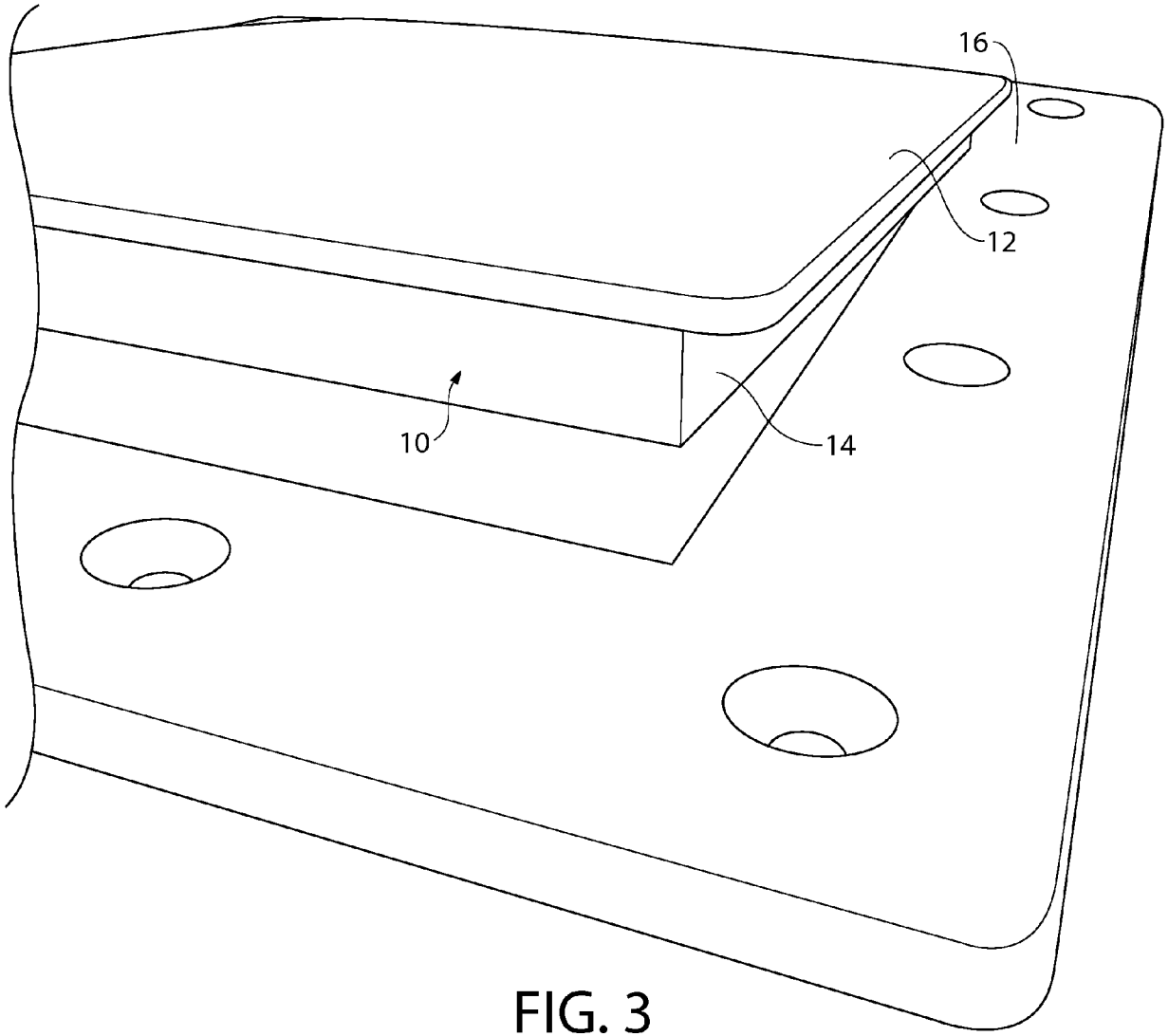
FIG. 3 is a close up view of another embodiment of the present invention being inserted into a standard skimmer faceplate.

Reference is now made, to FIGS. 1 through 3. The current embodiment of the present invention comprises a skimmer plug, generally designated 10. Skimmer plug 10 comprises rigid plate 12 and closed cell foam 14. Skimmer plug 10 is designed to create a water tight seal with faceplate 16.

Figure 4:
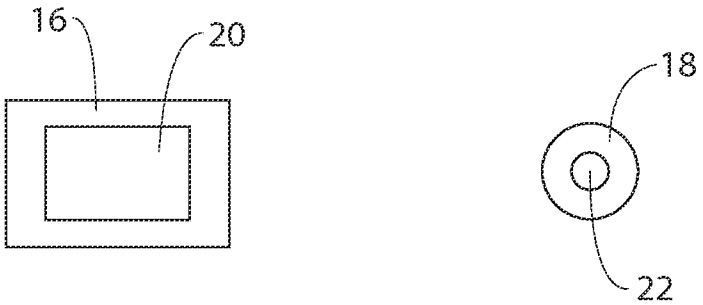
FIG. 4 is a schematic view of a typical skimmer and water return set.

Reference is now made to FIG. 4 which shows a typical skimmer and water return set. Skimmer plug 10 can be modified to fit any skimmer/water return set. For the present set, a rectangular skimmer plug is capable of sealing skimmer opening 20 in skimmer plate 16 and a round skimmer plug is capable of sealing water return 22 in water return frame 18.

Figure 5:
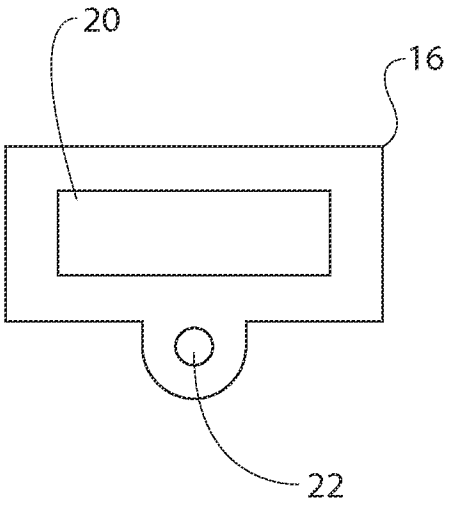
FIG. 5 is a schematic view of a combined skimmer and water return set.
Figure 7:
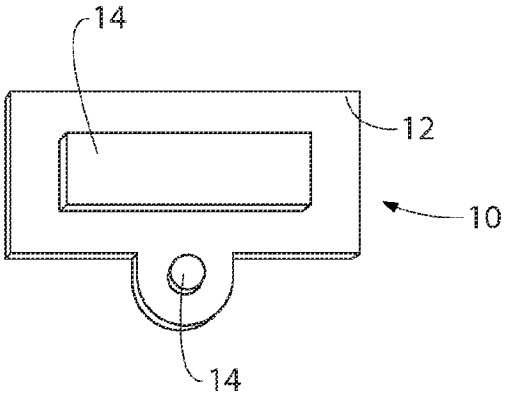
FIG. 7 is a general perspective view of one embodiment of the present invention for use with a combined skimmer and water return set.

Reference is now made to FIG. 5 and FIG. 7 which shows a combined skimmer and water return set, and one embodiment of the present invention for use with a combined skimmer and water return set respectively. Skimmer plug 10 can be modified, as shown in FIG. 7, to fit any skimmer/water return set. For the present set, a rectangular foam portion 14 and a circular foam portion 14 appropriately mounted on a single rigid plate 12 is capable of sealing skimmer opening 20 in skimmer plate 16 and water return 22 in skimmer plate 16.

Figure 6:
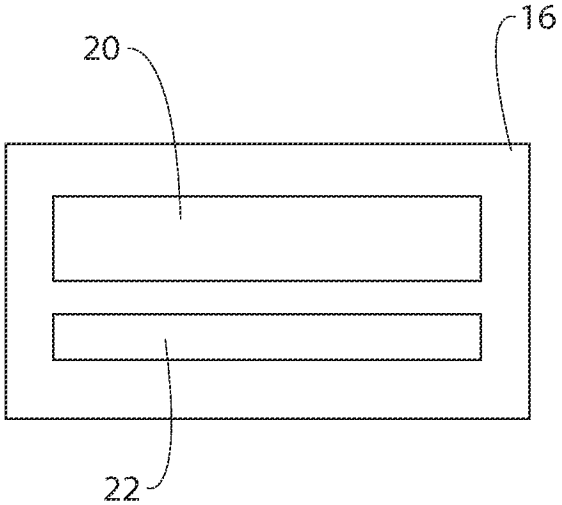
FIG. 6 is a schematic view of a combined skimmer and water return set.
Figure 8:
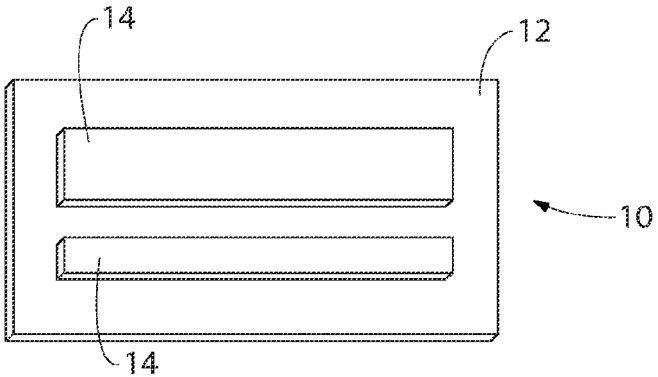
FIG. 8 is a general perspective view of one embodiment of the present invention for use with a combined skimmer and water return set.

Reference is now made to FIG. 6 and FIG. 8 which shows a combined skimmer and water return set, and one embodiment of the present invention for use with a combined skimmer and water return set respectively. Skimmer plug 10 can be modified, as shown in FIG. 8, to fit any skimmer/water return set. For the present set, a rectangular foam portion 14 and a narrower rectangular foam portion 14 appropriately mounted on a single rigid plate 12 is capable of sealing skimmer opening 20 in skimmer plate 16 and water return 22 in skimmer plate 16.

Figure 9:
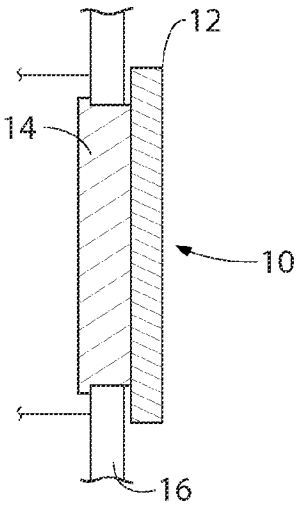
FIG. 9 is a general cross sectional view of a preferred embodiment of the present invention installed in a skimmer faceplate.

Reference is now made to FIG. 9 which shows a general cross sectional view of a preferred embodiment of the present invention 10 installed in a skimmer faceplate 16. When installed the foam portion 14 on rigid plate 12 forms around the interior edges of the skimmer plate 16 or other interior surfaces of a skimmer or outlet port or the like. Thereby, forming a waterproof seal even if the interior edges of the skimmer plate 16, or the like, are not uniform.

Figure 10:
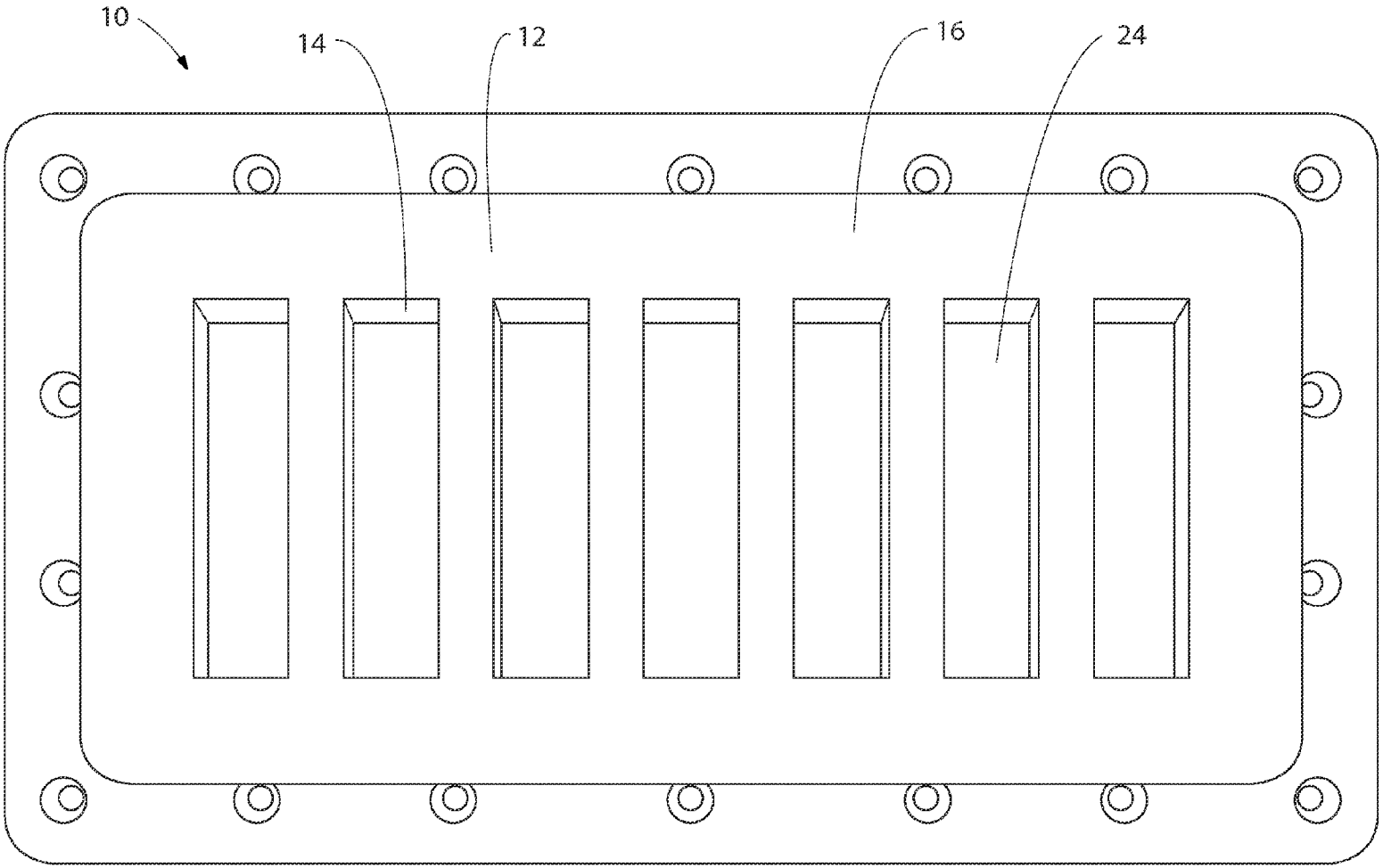
FIG. 10 is a general perspective view of a grille embodiment of the present invention installed in a standard skimmer faceplate.
Figure 11:
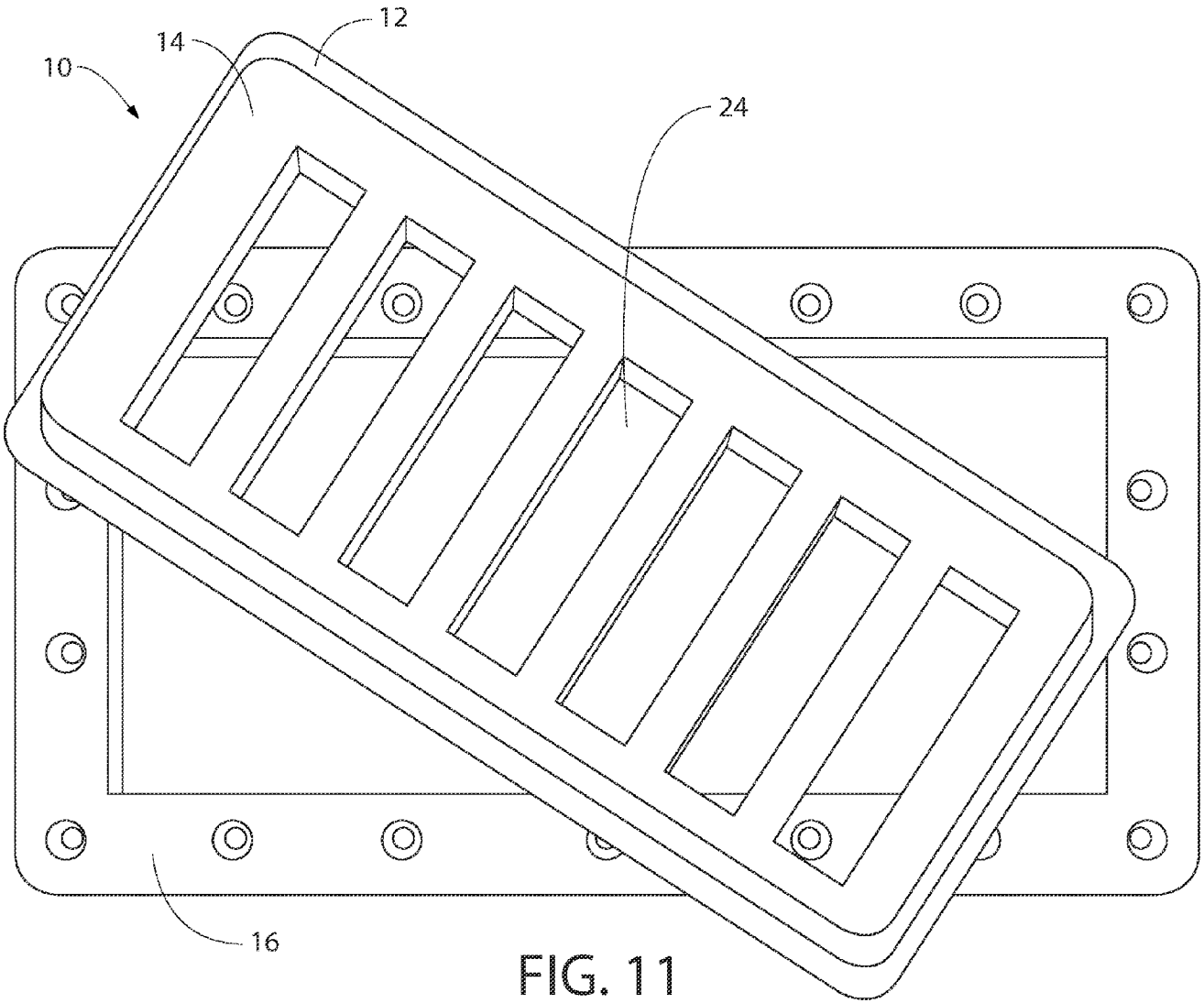
FIG. 11 is a general perspective view of a grille embodiment, shown foam side up, of the present invention with a standard skimmer faceplate.

Reference is now made to FIG. 10 and FIG. 11 which shows a general perspective view of a grille embodiment of the present invention installed in a standard skimmer faceplate a general perspective view of a grille embodiment, shown foam side up, of the present invention with a standard skimmer faceplate, and a general perspective view of a grille embodiment, shown foam side up, of the present invention with a standard skimmer faceplate. The construction and installation of this embodiment of the present invention is substantially similar to the other embodiments of the invention except for the addition of apertures 24 through the foam portion 14 and rigid plate 12 as shown in the figures. This embodiment is intended to provide a means for preventing unwanted items from moving into a skimmer. The size and shape of the apertures 24 can be modified depending on the particular application.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

The invention claimed is:

1. A swimming pool skimmer plug comprising:

a rigid plate, at least one foam member attached to said rigid plate, wherein said at least one foam member is shaped and sized to mechanically interface with a set of interior surfaces of a pool skimmer inlet, said mechanical interface includes a direct abutment between peripheral edge surfaces of said at least one foam member and respective interior surfaces from the set of the interior surfaces of said pool skimmer inlet, and wherein said rigid plate is constructed to prevent complete insertion of the swimming pool skimmer plug into said pool skimmer inlet.

2. The swimming pool skimmer plug of claim 1, wherein said rigid plate is constructed of a rigid plastic.

3. The swimming pool skimmer plug of claim 1, wherein said at least one foam member is constructed of a closed cell foam material.

4. The swimming pool skimmer plug of claim 1, wherein said at least one foam member is constructed of a closed cell foam rubber material.

5. The swimming pool skimmer plug of claim 1, wherein said rigid plate is constructed of a rigid plastic, and wherein said at least one foam member is constructed of a closed cell foam rubber material.

6. The swimming pool skimmer plug of claim 1, wherein said at least one foam member comprises at least two foam rubber members, wherein a first foam rubber member of said at least two foam rubber members is shaped and sized to mechanically interface with a set of interior surfaces of said pool skimmer inlet, and wherein a second foam rubber member of said at least two foam rubber members is shaped and sized to mechanically interface with a set of interior surfaces of a fluid outlet.

7. The swimming pool skimmer plug of claim 1, wherein said swimming pool skimmer plug comprises at least one aperture through said rigid plate and at least one aperture through said at least one foam member to enable fluid communication through said pool skimmer inlet.

8. The swimming pool skimmer plug of claim 1, wherein said rigid plate is constructed of a rigid plastic, and wherein said at least one foam member is constructed of a neoprene material.

9. A swimming pool winterization system comprising:

a set of swimming pool skimmer plugs comprising;

two or more rigid plates, a foam member attached to a surface of each of said two or more rigid plates, wherein said foam member is shaped and sized to mechanically interface with a set of interior surfaces of a selected pool orifice, said mechanical interface includes a direct abutment between peripheral edge surfaces of said foam member and respective interior surfaces from said set of said interior surfaces of the pool orifice, and wherein said rigid plate is constructed to prevent complete insertion of the swimming pool skimmer plug into said pool orifice.

10. The swimming pool winterization system of claim 9 wherein the set of swimming pool skimmer plugs are capable of blocking fluid flow through all orifices of a pool.

11. The swimming pool winterization system of claim 9 wherein the set of swimming pool skimmer plugs are configured to block fluid flow through all orifices of a pool once inserted into respective pool orifices.

12. A swimming pool skimmer plug comprising:

a member, a foam member attached to one surface of said member, and a fit between exterior edge surfaces of said foam member and respective interior surfaces of a pool skimmer opening when said foam member is inserted into the pool skimmer opening, said fit being configured such that said peripheral edge surfaces of said foam member directly abut the respective interior surfaces of the pool skimmer opening.

13. The swimming pool skimmer plug of claim 12, wherein said fit also includes an outward expansion of said foam member and abutment of said foam member with a portion of an interior surface of a pool skimmer member having the pool skimmer opening formed therethrough, the portion being disposed around the pool skimmer opening.

14. The swimming pool skimmer plug of claim 12, wherein said fit provides a water tight seal.

15. The swimming pool skimmer plug of claim 12, further comprising apertures formed through a thickness of said member and a thickness of said foam member.

16. The swimming pool skimmer plug of claim 12, further comprising another foam member positioned in a spaced apart relationship with said foam member.

17. The swimming pool skimmer plug of claim 15, wherein said another foam member is sized and shaped to fit a water return opening provided in the pool skimmer.

18. The swimming pool skimmer plug of claim 12, wherein each exterior edge surface of said foam member is spaced inwardly from a respective edge of said member.

19. The swimming pool skimmer plug of claim 12, wherein said member is sized and shaped to prevent a complete insertion of said member into the pool skimmer opening.

* * * * *